United States Patent [19]

Albin et al.

[11] Patent Number: 4,462,955

[45] Date of Patent: Jul. 31, 1984

[54] SUPPORT DEVICE POSITIONED BETWEEN AN ELEMENT OF LARGE MASS AND A FIXED SUPPORT

[75] Inventors: Michel Albin, Vaucresson; Dominique B. Pillon, Neuilly-Sur-Seine, both of France

[73] Assignee: Framatome, Courbevoie, France

[21] Appl. No.: 313,924

[22] Filed: Oct. 22, 1981

[30] Foreign Application Priority Data

Nov. 14, 1980 [FR] France ..... 80 24242

[51] Int. Cl.[3] ..... G21C 17/00; E02D 27/34

[52] U.S. Cl. ..... 376/272; 376/285; 376/381; 376/461; 52/167; 248/562

[58] Field of Search ..... 376/272, 285, 381, 461; 52/167; 248/562

[56] References Cited

U.S. PATENT DOCUMENTS

| | | | |
|---|---|---|---|
| 1,761,659 | 6/1930 | Cummings | 52/167 |
| 1,761,660 | 6/1930 | Cummings | 52/167 |
| 3,901,196 | 8/1975 | Dorner et al. | 376/285 |
| 3,986,367 | 10/1976 | Kalpins | 376/285 |
| 4,189,347 | 2/1980 | Reutler et al. | 376/381 |
| 4,302,293 | 11/1981 | Elter et al. | 376/381 |
| 4,328,648 | 5/1982 | Kalpins | 52/167 |
| 4,371,143 | 2/1983 | Ishida et al. | 52/167 |

FOREIGN PATENT DOCUMENTS 860166 2/1961 United Kingdom .

*Primary Examiner*—Sal Cangialosi

*Attorney, Agent, or Firm*—Pollock, Vande Sande & Priddy

[57] ABSTRACT

An anti-earthquake support device arranged between an element of large mass and a fixed support, comprising roller elements arranged between support parts forming roller tracks inclined with respect to the horizontal plane. The roller elements are cylindrical rollers (14,15,17) arranged horizontally in two superposed sets of rollers with perpendicular axes. The support parts (4,10 and 11) are entirely independent of one another and are arranged above one of the sets of roller for the first (4), between the two sets of rollers for the second (10) and beneath the second set of rollers for the third (11). The corresponding roller tracks (9, 20, 21 and 24) are formed on either the lower, or the lower and upper, or the upper surfaces of the three support parts (4, 10 and 11), respectively. The invention is used for the support of a fuel assembly rack for a nuclear reactor on the bottom of the storage pool of such reactor.

4 Claims, 2 Drawing Figures

SUPPORT DEVICE POSITIONED BETWEEN AN ELEMENT OF LARGE MASS AND A FIXED SUPPORT

FIELD OF THE INVENTION

The invention relates to a support device positioned between an element of large mass and a fixed support, enabling the movements and the accelerations of the element with respect to the support to be limited, during movements caused by stresses such as those arising from an earthquake.

BACKGROUND OF THE INVENTION

In the construction of structures or in the positioning of machines, it is necessary to support structures or equipment of heavy mass on fixed supports such as foundations or support slabs.

For example, support devices are known designed to transmit forces between the supported element and the support which are constituted by anchorages or articulations.

These devices transmit the forces integrally between the bearing structure and the borne element. This presents drawbacks in particular in the case where large stresses such as those accompanying an earthquake are transmitted to the supported element.

In particular, in the case of construction of nuclear reactors, for safety reasons one may be led to avoid the use of such support devices which can place the supported structures or equipment in danger, in the case of a considerable stress coming, for example, from the ground.

More elaborate support devices have therefore been conceived which absorb or limit such forces.

For example, the use of flat or curved sliding pads or of pads associated with stops or energy absorbers has been proposed.

Devices including support parts forming bearing tracks and elements such as balls have also been proposed, assuring in association the support of the structure.

Devices have been conceived, for example, associating two disks having concave surfaces with balls arranged between these two concave surfaces and pendular yokes with a spherical journal, for the support of structures or machines in order to reduce the forces transmitted to the borne element from the support.

If these devices indeed reduce the forces transmitted, they can only limit the relative movements of the bearer elements and of the borne element by the use of stops or energy absorbers, to avoid too large a deformation of the borne element.

On the other hand, systems with balls or with spherical bearings, if they have a good reaction to forces of any direction, are unusable as soon as the borne mass exceeds a certain threshold, i.e., when support by contact on a small surface is not possible.

SUMMARY OF THE INVENTION

It is an object of the invention, therefore, to provide a support device arranged between an element of large mass and a fixed support, enabling the movements and accelerations of the element with respect to the support to be limited, during movements caused by stresses such as those arising from an earthquake, comprising bearing elements arranged between support parts forming tracks for the bearing elements inclined with respect to the horizontal plane and assuring the transmission of the vertical forces of inertia from the element to the support. The support device must permit reduction of the forces transmitted to the borne element of large mass while avoiding large movements of excessive amplitude, whatever the direction and origin of the forces exerted between the support and the borne element.

For this purpose, the support device according to the invention comprises:

bearing elements constituted by cylindrical rollers arranged horizontally on superposed sets of at least two rollers, the rollers of one set having their axes perpendicular to the axes of the rollers of the other set, and a set of three support parts totally independent of one another, comprising a first support part on which the borne element rests directly and supported on the upper set of rollers, a second part on which rests the upper set of rollers and supported on the lower set of rollers, as well as a third support part resting on the fixed support and supporting the lower set of rollers, the first support part having a bearing track on its lower surface, the third part having a bearing track on its upper surface, and the second support part having a track on both its upper surface and its lower surface.

In order that the invention may be more clearly understood, there will now be described, with reference to the accompanying drawings, an embodiment of a support device according to the invention applied to the support of racks of fuel elements on the bottom of the storage pool of a pressurized water nuclear reactor.

DETAILED DESCRIPTION

Figure 1:
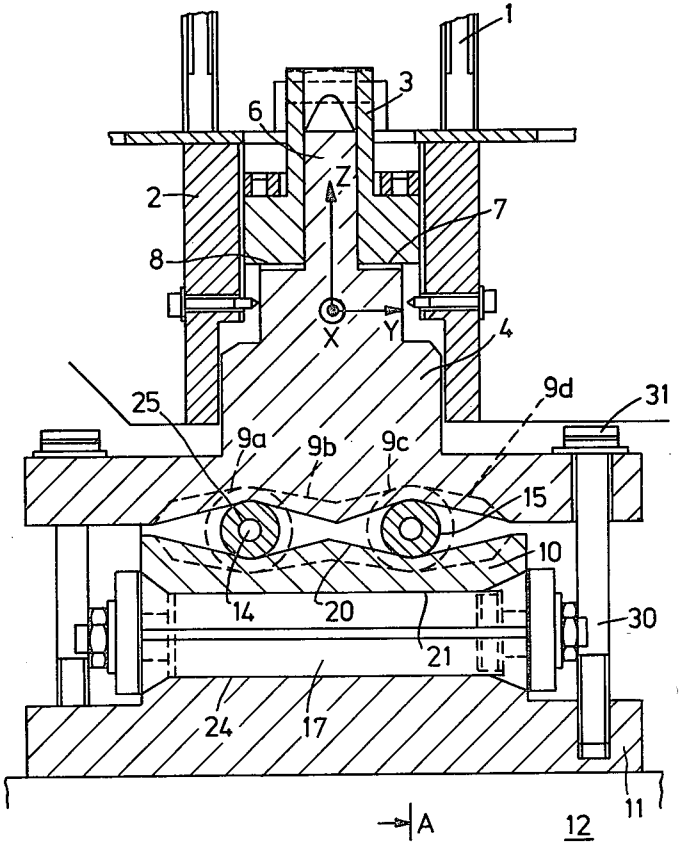
FIG. 1 is a sectional view through a vertical plane of symmetry of an embodiment of the device according to the invention.

FIG. 1 shows a portion of a rack for a fuel element 1 fast at its lower part to a support structure 2 comprising part 3 for the engagement of the support structure 2 on the upper end of the support device according to the invention.

The upper part of this support device is constituted by a support part 4 the upper portion of which, engaged in the part 3 of the support structure of the rack of fuel elements, is constructed in the shape of a vertical pin 6 including a shoulder 7 on which the structure 2 comes to rest with the interposition of support pads 8.

Figure 2:
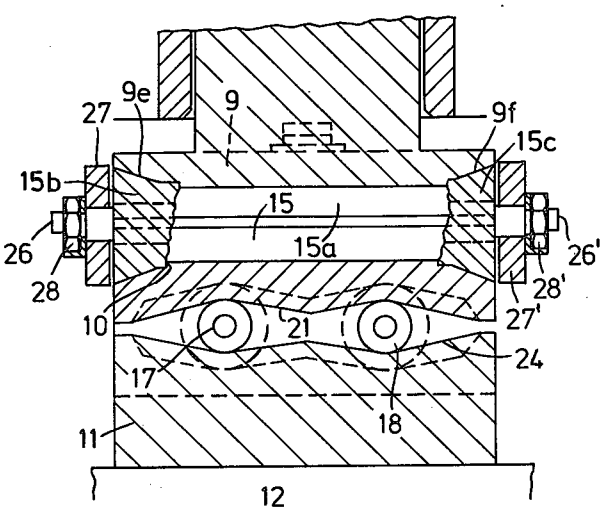
FIG. 2 is a sectional view along the line A of FIG. 1.

Referring to FIGS. 1 and 2, it is seen that the lower portion of the part 4, of greater width than the upper portion, has a profiled portion 9 constituting a roller path.

This roller path 9 is machined on the lower surface of the part 4.

The support device comprises also a second intermediate support part 10 and a third support 11 itself resting on the bottom 12 of the pool of the fuel of the reactor.

Between the support parts 4 and 10, are arranged two rollers with horizontal axes 14, 15, while between the support parts 10 and 11 are also arranged two rollers, with horizontal axes 17 and 18.

The axes of the rollers 14 and 15 parallel with one another are oriented in a horizontal direction X, while the axes of the parallel rollers 17 and 18 are oriented in a second horizontal direction Y perpendicular to the direction X.

The support part 10 has on its upper surface a roller track 20 and on its lower surface another roller track 21.

The support part 11 comprises a roller track 24 on its upper surface.

The rollers 14 and 15 are in contact through tracks 9 and 20 with the support parts 4 and 10, respectively.

The rollers 17 and 18 are in contact with the parts 10 and 11 through tracks 21 and 24, respectively.

The tracks 9 and 20 on the one hand, and 21 and 24 on the other hand, have a profiled shape in the transverse direction with respect to the rollers and have, in this direction, a succession of ramps (such as 9*a*, 9*b* and 9*o* on the roller path 9) having successively rising and descending profiles.

The profiles of the ramp portions of two opposite, facing roller tracks (such as 9 and 20) are reversed.

The rollers 14, 15, 17 and 18 comprise a cylindrical central portion and two terminal portions of short conical length enabling the centering of these rollers with respect to the roller tracks which are also profiled in the longitudinal direction with respect to the rollers to represent two inclined lateral parts such as 9*e* and 9*f* for the roller track 9.

For example, the roller 15 comprises a cylindrical central portion 15*a* and two conical end parts 15*b* and 15*c* which come respectively into support on the inclined surfaces 9*e* and 9*f* of the roller track 9.

The rollers have rotational axes (such as 25 for the roller 14) which enable the rollers 14 and 15 on the one hand and 17 and 18 on the other hand to be connected, through a linking element such as 27 traversed by the end of the axle 26 of the roller 15 on which is screwed a nut 28 (or the set 26', 27', 28' at the other end of the roller).

The rollers 14 and 15 on the one hand and 17 and 18 on the other hand are thus connected to one another with a constant axial separation at each of their ends.

Upon positioning of the support device on the bottom of the pool, the support parts and the rollers are kept in contact by means of screws 30 with a hexagonal head 31 enabling the supports 4 and 11 to be connected, and to exert a sufficient force between the supports and the rollers.

When the support device has been placed in position, the linkages between the supports 4 and 11 are eliminated by removing the screws 30.

The three support parts are then totally independent.

When the borne element constituted by the fuel element rack is urged by a force in the direction X or in the direction Y, there occurs a movement of the element with respect to the support surface 12, either by movement of the set constituted by the borne element, the supports 4 and 10 as well as the set of upper rollers 14 and 15 with respect to the support part 11, by rolling of the roller 17 and 18 on the tracks 21 and 24, or by movement of the set constituted by the borne element and the support 4 with respect to the support 10, by rolling of the roller 14 and 15 on the tracks 9 and 20.

If the borne element undergoes a stress in a different direction from X and from Y, the movement of this element with respect to the support surface 12 occurs at the same time through rolling of the rollers 14 and 15 and of the rollers 17 and 18.

In all cases, the horizontal translation can only occur with a vertical movement of the upper part, hence of the borne element. The mass of the borne element is countered by gravity in the vertical movement, which permits, with a judicious choice of the shape of the profiles of the rollers paths, the selective combination of the acceleration and the displacement of the element with respect to the support.

In all cases where the stresses originate in the fixed support, for example in the case of an earthquake causing large oscillations of the ground and of the support surface resting on the ground, the action of the support device to reduce the displacements and/or the accelerations of the borne element with respect to the support brings into play the same displacements as those which have been described in the case of a horizontal displacement of the borne element with respect to the fixed support.

In all cases, the inertial forces in the vertical direction along an axis Z perpendicular to the axes Z and Y are transmitted integrally from the borne element to the bearer element, or conversely. In this case, neither the displacements nor the accelerations are therefore attenuated by the device according to the invention.

In reality, in the case of an assembly rack for nuclear reactors, these racks are constituted by juxtaposed modular elements, and each of these modular elements is placed and supported on four devices of the type described. The reaction of the whole of the support device constituted by four elementary devices is similar to that of the elementary system itself.

The invention is not limited to the embodiment which has just been described.

Thus it is possible to conceive the use of any number of rollers in each of the upper or lower sets of the support device.

These different rollers can be arranged with a fixed difference between centers by means of a junction bar connecting their axles, or they can be arranged freely individually or in partial groups, by provision of a special shape of the bearing tracks holding the rollers in spaced positions.

The roller tracks can be attached to the support parts or machined directly in the the support parts.

The rollers themselves can be produced in monoblock form or include several parts threaded onto the same axle.

It is also possible to intercalate, between the lower support part resting on the fixed support and this fixed support, mechanical or hydraulic supporting and regulating means enabling the horizontality of the set of lower rollers to be regulated.

Finally, the device according to the invention can find application outside of supports of racks for fuel assemblies in the storage pool of a pressurized water reactor.

Thus it is possible to use these support devices each time that it is desired to avoid distortions of a supported structure which can undergo mechanical or thermal stresses. In all cases, the device enables the induced accelerations and the displacements to be minimized without the use of guidance locking or damping devices placed laterally with respect to the structure.

We claim:

1. Support device positioned between an element of predetermined mass (1) and a fixed support (12), enabling limitation of displacements and accelerations of said element with respect to said support upon movements caused by severe stresses, said device comprising (a) cylindrical rollers (14, 15, 17, 18) arranged horizontally in two superposed sets of at least two parallel rollers, the rollers of one set (14, 15) having their axes perpendicular to the axes of the rollers of the other set (17, 18); and (b) a set of three superposed support elements totally independent of one another and having on their facing sides roller tracks (9, 20, 21, 24) inclined to the horizontal, the rollers (14, 15) of said one set being arranged between the uppermost (4) of said support elements carrying said element of large mass (1) and the intermediate one (10) of said three support elements in contact with said roller tracks (9, 20); the rollers (17, 18) of said other set between said intermediate support element (10) the lowermost (11) of said support elements resting on said fixed support (12), in contact with said roller tracks (21, 24) provided on said elements;

(c) each of said rollers (14, 15, 17, 18) comprising in axial direction a central portion of revolution (15*a*) and two end portions of revolution (15*b*, 15*c*) flared outwardly inclined at an acute angle to the horizontal plane, said roller tracks (9, 20, 21, 24) having profiles corresponding to those of said rollers in the longitudinal direction of the latter.

2. Support device according to claim 1, wherein said element (1) is a storage rack for a fuel assembly for a nuclear reactor, and wherein said lowermost (11) support element rests on the bottom (12) of a storage pool of said reactor, said support device and said storage rack being entirely immersed in the water of said storage pool.

3. Support device according to claim 1, wherein the rollers belonging to each of said sets are made fast at a fixed distance between axes by a linking part connected to the rotational axles of said rollers.

4. Support device according to any of the preceeding claims, wherein said third support element rests on said fixed support through regulating means for the position of said third support element to assure the horizontality of said first set of rollers.

* * * * *